United States Patent [19]

Mizuno et al.

[11] Patent Number: 4,994,859

[45] Date of Patent: Feb. 19, 1991

[54] POWER CLOUD DEVELOPING APPARATUS WITH A FIRST AND SECOND ELECTRIC FIELD CURTAIN GENERATING MEANS

[75] Inventors: Hiroshi Mizuno; Hideo Hotomi; Yoshihisa Terasaka; Masahiro Anno, all of Osaka, Japan

[73] Assignee: Minolta Camera Kabushiki Kaisha, Osaka, Japan

[21] Appl. No.: 535,533

[22] Filed: Jun. 11, 1990

[30] Foreign Application Priority Data

Jun. 14, 1989 [JP] Japan ..... 1-151532

[51] Int. Cl.[5] ..... G03G 15/08

[52] U.S. Cl. ..... 355/247; 355/265; 118/654

[58] Field of Search ..... 355/247, 265, 262, 261, 355/263; 118/648, 654, 650

[56] References Cited

U.S. PATENT DOCUMENTS 4,431,296 2/1984 Haneda et al. ..... 118/654 X

FOREIGN PATENT DOCUMENTS 56-27158 3/1981 Japan .

59-181370 10/1984 Japan .

*Primary Examiner*—A. T. Grimley

*Assistant Examiner*—S. Y. Lee

*Attorney, Agent, or Firm*—Burns, Doane, Swecker & Mathis

[57] ABSTRACT

A developing apparatus for use in an electrophotographic apparatus and like, which is adapted to supply a developing material without contact between a developing material support member and an image holding member by utilizing the action of an electric field curtain, wherein the developing material can be transported to the image holding member with requiring no necessities for a large voltage to be impressed thereto and for floating, so that it is prevented that the developing material is scattered during the transportation thereof or a formed image is subjected to fogging.

8 Claims, 2 Drawing Sheets

POWER CLOUD DEVELOPING APPARATUS WITH A FIRST AND SECOND ELECTRIC FIELD CURTAIN GENERATING MEANS

BACKGROUND OF THE INVENTION

1. Field of the Invention

The present invention generally relates to a developing apparatus for use in an electrophotographic apparatus or the like and, more particularly, to a developing apparatus utilizing the action of an electric field curtain.

2. Description of the Prior Art

Conventionally, for a developing apparatus to be used in an electrophotographic apparatus widely applied to a copying machine, facsimile, printer etc. not only two-component system by the cascade method or magnetic brush method etc., but one-component system has been well employed. The one-component system has been disclosed in, for example, U.S. Pat. No. 2,725,304 by the power cloud method, Japanese Patent Publication Nos. 41-9475 by the touch-down method, 45-2877 by the impression method or 54-3624 by the jumping method.

Meanwhile, because of the recent trend in the electrophotography requiring colored images, such kind of a developing apparatus has attracted the notice of people that can develop image while overlapping developing materials of various colors onto an image holding member such as a photosensitive member, without contact between the image holding member and a developing material support member.

In the developing apparatus of the type referred to above which can develop image without contact of the image holding member with the developing material support member, utilization of the aforementioned powder cloud method or jumping method has been well practiced.

According to the powder cloud method, however, since the developing apparatus is so arranged that charged toners are jetted out by a flow of air into a cloud of toners, and the image holding member formed with an electrostatic latend image thereon passes through the toner cloud, thereby realizing the supply of charged toners to the developing material support member through the image holding member, the apparatus tends to be complicated in structure and bulky in size, having difficulties in control of the toner cloud floating in the air.

On the other hand, in the developing apparatus employing the jumping method, toners move reciprocally to and fro between the developing material support member and the image holding member, and therefore it is difficult to obtain an image of high resolution. Moreover, toners of various colors are prone to be mixed during the development of an image in an overlapping manner.

Taking note of the above drawbacks, recently, a developing apparatus utilizing the action of an electric field curtain has been developed which supplies the developing material without contact thereof with the image holding member, such as disclosed in Japanese Patent Laid-open Publication Nos. 47-47811, 58-202217, 59-176755, 59-181371, 59-189367, 63-13068 and so on.

The developing apparatus utilizing the action of the electric field curtain is fundamentally in such arrangement, as shown in FIG. 1, that an alternating voltage is applied between electrodes 1 by an alternating voltage source 2, thereby causing a non-uniform alternating field having an electric line of force as indicated by a broken line to act between the electrodes 1, with allowing toners 3 to float to a developing area confronting the image holding member, and there in the developing area, the toners are supplied to a position of an electrostatic latent image on the image holding member by the action of the electric field curtain.

The above electric field curtain will be more clearly described hereinbelow with reference to FIG. 1.

As mentioned above, as charged toners 3 come close to the electric field area where the electric line of force is formed by the application of the alternating voltage from the alternating voltage source 2 to the electrodes 1, the toners 3 receive an alternating electric force in a direction along the electric line of force, and accordingly the toners 3 vibrate approximately along the curved electric line of force.

In addition to an external force Fe such as gravity etc., the toners 3 receive, every half cycle of the vibration, a centrifugal force Fc outwardly perpendicular to a tangent line of the electric line of force, and further receive an average gradient force Fg along the electric line of force. The centrifugal force Fc and average gradient force Fg act following the spatial change respectively in a direction of the electric line of force and in a density of the electric line of force, both of which result from the non-uniform and alternating electric field.

An electrodynamic force Fr (=Fc+Fg) acting on the charged toners 3 charged by the standing wave electric field curtain is represented as follows:

$$Fr = -\text{grad}\ \psi e$$
$$= -K[(\text{grad})b(f^2)]$$

wherein $$\psi e = Kbf^2.$$

$$K = \frac{q^2V^2}{4m\omega^2[1 + (6\pi\eta a/m\omega^2)]b^3}$$

$$K = \frac{qY2H\xi^2E\max^2}{4m\omega^2[1 + (6\pi\eta a/m\omega^2)]b^3}$$

wherein m[Kg] denotes a mass of a toner particle, a[m] denoting a radius of the toner particle, q[c] a charge amount of the toner particle, $\omega[s^{-1}]$ an angular frequency of a power source, $\eta[N.s/m^2]$ an air viscous resistance, E[V/m] a field intensity, V[V] an impressing voltage, b[m] a minimum distance between surfaces of neighboring electrodes, Emax[V/m] a maximum field intensity on the surface of an electrode, H=(v/b)/Emax an utilization rate of electric field, f=E(V/b) a standardized electric field, (grad)b a grad in a coordinates system (r/b, z/b) standardized by b, respectively.

More specifically, the force by the electric field curtain depends on conditions at the side of the toner particle constituted of the mass m of the toner particle, the radius a of the toner particle and the charge amount q of the toner particle, and also external conditions, that is, the field intensity E and the source frequency f(=w/2π). Therefore, it becomes possible to float the toner particles in the air by adjusting the above conditions properly Accordingly, in the developing apparatus utilizing the action of the electric field curtain, toners can be floated by the action of the electric field curtain as described above, and brought into soft contact with the image holding member to be fed onto the position of the electrostatic latent image. Therefore, in comparison with the developing apparatus utilizing the powder cloud method or jumping method, overlapping development with many colors becomes well achieved, although it is necessary to charge toners sufficiently in transportation thereof.

In view of the above, some improving idea has been proposed as disclosed in Japanese Patent Laid-open Publication No. 58-202217 and 63-13066 etc. in which a group of electrode acting the effect of the electric field curtain is partially exposed to carry out corona discharge thereby, so that the toners are forcibly charged.

It is required, however, to apply a remarkably high voltage to the electrodes for transporting the toners charged by the corona discharge by the action of the electric field curtain, which leads to deterioration of insulation of a dielectric member in a short period of time, with reducing the service life of the apparatus itself. Furthermore, it causes a number of problems such as generation of ozone and noises.

Moreover, in the case where toners which are not charged to a proper charge amount are floated for transportation by the action of the electric field curtain, the insufficiently-charged toners may be scattered or fogging may be formed in a resultant image.

SUMMARY OF THE INVENTION

An essential object of the present invention is to provide a developing apparatus for use in an electrophotographic apparatus and the like, with an aim to substantially eliminating the above-described disadvantages inherent in the prior art, which is adapted to supply a developing material without contact between a developing material support member and an image holding member such as a photosensitive member by utilizing the action of an electric field curtain, wherein the developing material can be transported stably to the image holding member with requiring no necessities for a large voltage to be impressed thereto and for floating, so that it is prevented that the developing material is scattered during the transportation thereof or a formed image is subjected to fogging.

In accomplishing the above-described object, according to the present invention, the developing apparatus is provided with an electrostatic latent image holding member for holding an electrostatic latent image, a developing material support member, the electrodes on the developing material support member for generating an electric field curtain, and an alternating voltage impressing means for impressing an alternating voltage to the electrodes only in a developing area where the developing material support member confronts the image holding member.

In the developing apparatus having the above-described construction, when the developing material is transported to the developing area where the developing material support member confronts the image holding member, the developing material support member is driven to transport the developing material, without causing the electric field curtain to act. Accordingly, as compared with the case where the developing material is transported while it is being charged and floated by the action of the electric field curtain, it is not necessary to impress a considerably high voltage to the electrodes with for generating the electric field curtain. Moreover, the developing material is less scattered during the transportation.

When the developing material reaches the developing area, an alternating voltage is applied from the alternating voltage impressing means to the electrode thereby to cause the electric field curtain to act, so that the transported developing material is floated and supplied to the position of a latent image on the image holding member without contact thereto.

BRIEF DESCRIPTION OF THE DRAWINGS

This and other objects and features of the present invention will become apparent from the following description taken in conjunction with preferred embodiments thereof with reference to the accompanying drawings throughout which like parts are designated by like reference numerals, and in which.

DESCRIPTION OF THE PREFERRED EMBODIMENTS

Figure 1:
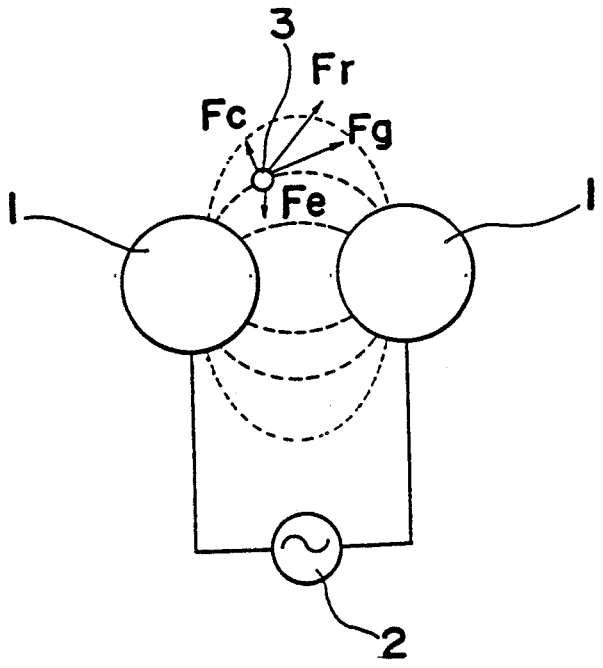
FIG. 1 is a view explanatory of the principle of an electric field curtain.
Figure 2:
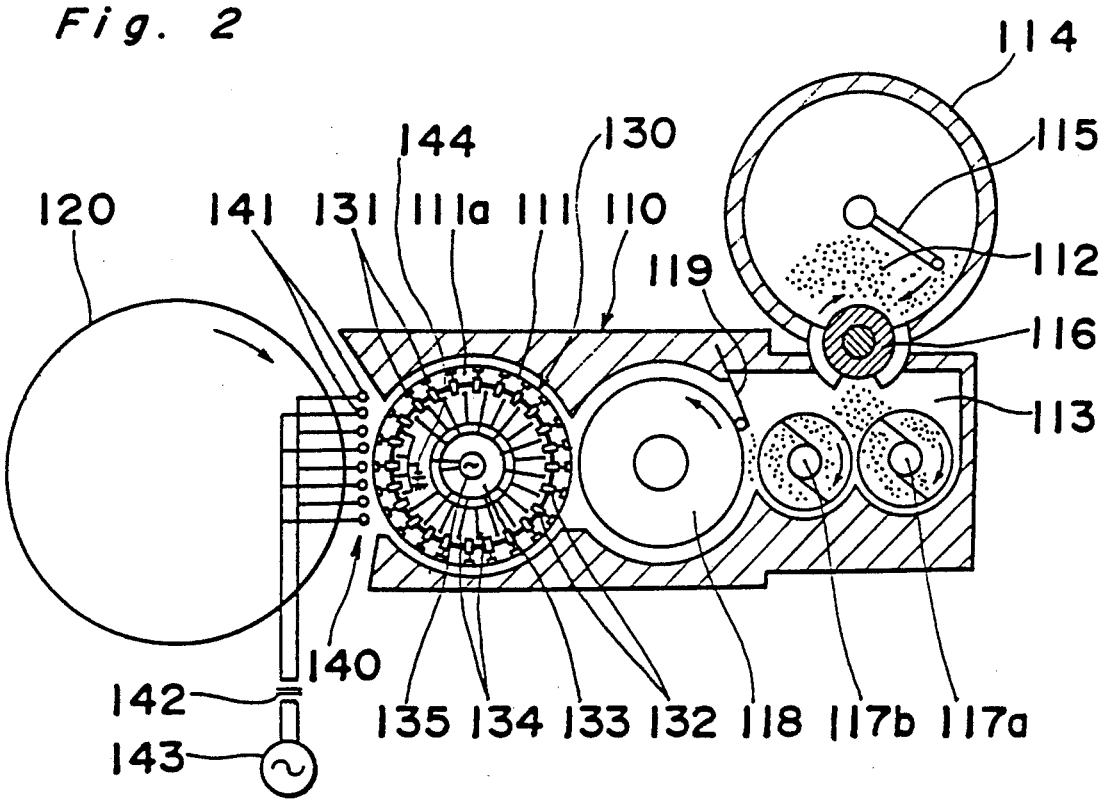
FIG. 2 is a schematic cross sectional view of a developing apparatus according to a second embodiment of the present invention.

As shown in FIG. 2, a developing apparatus 110 according to an embodiment of the present invention is provided with a cylindrical developing material support member 111 for transporting a developing material 112. The developing material support member 111 is arranged to confront a drum-like image holding member 120, and rotate in a direction opposite to that of the image holding member 120.

There is also provided an electric field curtain generating means 130 on the developing material support member 111 in the developing apparatus of the embodiment, whereby the electric field curtain is caused to act in a position except the developing area where the support member 111 confronts the image holding member 120 for transportation of the developing material.

In the developing apparatus 110, the developing material 112 is accommodated in a developing material container 113 provided behind the support member 111, that is, away from the image holding member 120. Fresh developing material 112 is supplied from a hopper 114 provided above the container 113 to the container.

When the developing material 112 is to be supplied to the container 113 from the hopper 114, the developing material 112 is stirred by a stirring means 115 provided in the hopper 114, and at the same time, a supply roller 116 between the hopper 114 and the container 113 is rotated. Therefore, a proper amount of the developing material 112 is able to be supplied from within the hopper 114 to the container 113.

Moreover, when the developing material 112 accommodated in the container 113 is to be supplied to the support member 111, a first and a second stirring vanes 117*a* and 117*b* provided in the container 113 are rotated. The developing material 112 is mixed and stirred when it is sent to the support member 111 through a sleeve roller 118 which is provided between the vanes 117*a*, 117*b*, and the support member 111.

The developing material 112 supplied to the sleeve roller 118 is transported to the side of the support member 111 in accordance with the rotation of the sleeve roller 118. However, in the halfway to the support member 111, the developing material 112 is pressed and charged by a blade 119 provided above the sleeve roller 118, and at the same time, the thickness of the layer of the developing material 112 is controlled properly by the blade 119.

When the charged developing material 112 reaches the support member 111, the alternating voltage is applied from an alternating voltage source 135 to electrodes 131 on the support member 111 at positions except the developing area as described later, resulting in the action of the electric field curtain. Accordingly, the charged developing material 112 is, while floating, transported to the developing area opposite to the image holding member 120 as the support member 111 is rotated.

If the charged developing material 112 is transported to the developing area in the above-described manner, the bias voltage is added to the electrodes 131 in the developing area by a bias voltage source 144, thereby forming an electric field between the support member 111 and electrode wires 141. Because of the action of the electric field, the fully-charged developing material 112 is consequently drawn to the side of the electrode wires 141 provided between the support member 111 and the image holding member 120.

Then, the developing material 112 is brought in soft contact with the image holding member 120 while it is floating between the electrode wires 141 and finally fed to the position of the electrostatic latent image on the image holding member 120.

Figure 3:
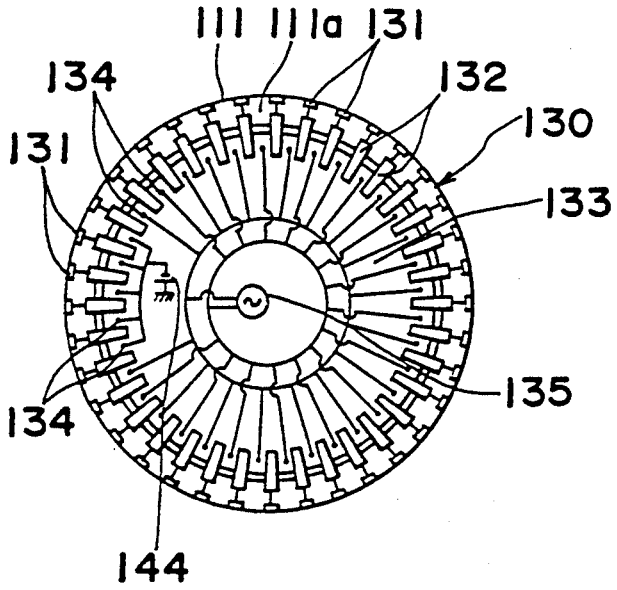
FIG. 3(A) and 3(B) are respectively a cross sectional view and a fragmentary side sectional view of a developing material support member used in the apparatus of FIG. 2.
Figure 3:
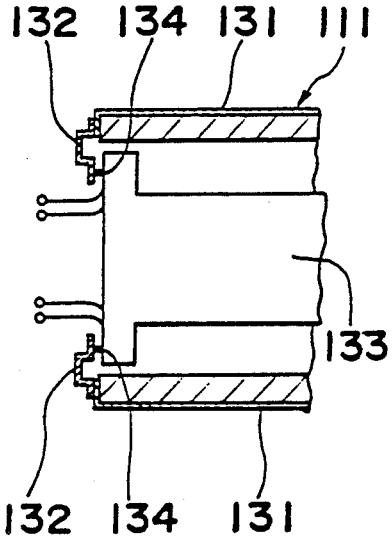
Figure 4:
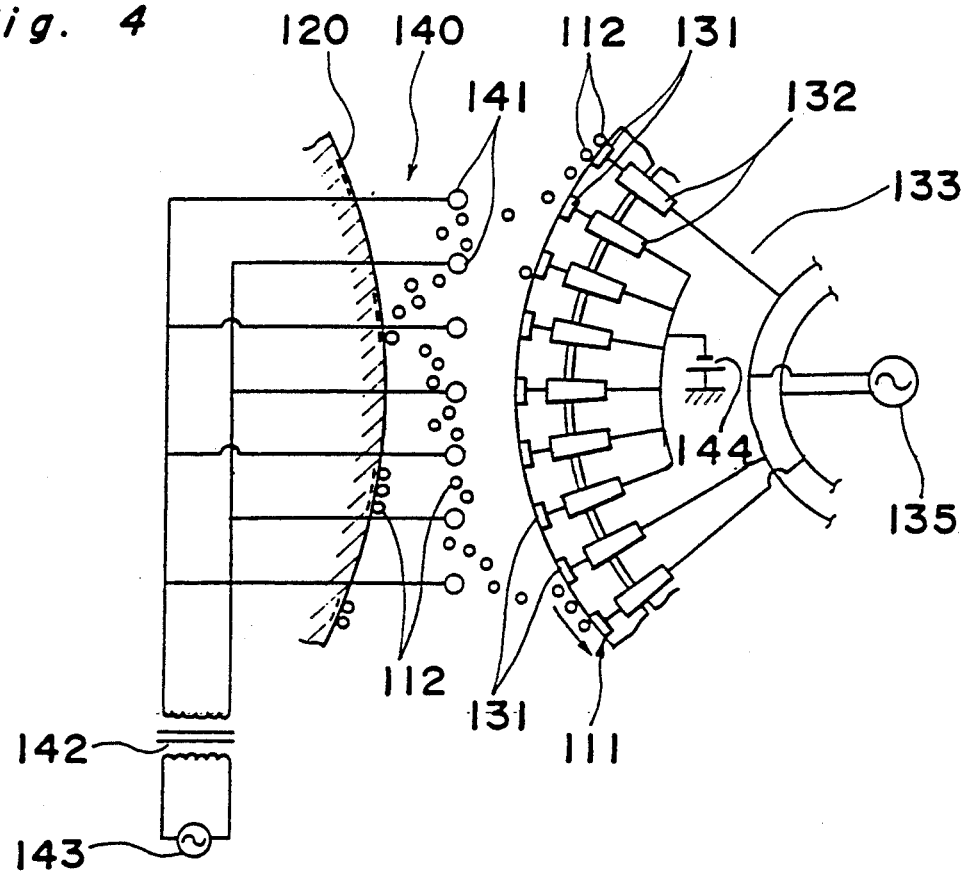
FIG. 4 is a fragmentary cross sectional view on an enlarged scale showing the state that the developing material is supplied from the developing material support member to an image holding member in the apparatus of FIG. 2.

The electric field generating means 130 is provided with a plurality of linear electrodes 131. In the outer peripheral surface of the developing material support member 111, as indicated in FIGS. 3 and 4, the plurality of linear electrodes 131 for generating an electric field curtain are aligned in parallel in an axial direction of the support member 111 with an equal distance from each other on the surface or in the periphery adjacent to the surface of an insulation layer 111*a* made of an insulative material composed of synthetic resin such as polycarbonate, nylon, fluoric resin, polyacetal, phenol or polyethylene, and rubber such as nitrile rubber, silicone rubber, styrene rubber or butadiene rubber.

A conductive elastic plate 132 which is bent to have a laterally projecting part is provided in the side end face of the support member 111 in a confronting manner to the electrode 131, so that the conductive elastic plate 132 is component to the respective electrode 131.

Moreover, an inner roller 133 is accommodated inside the support member 111 in a manner not to rotate. At the same time, a number of fixed electrodes 134 each confronting to the respective electric field curtain generating electrode 131 are provided in the side end face of the inner roller 133 at positions except the developing area, to be impressed with an alternating voltage from the alternating voltage source 135.

The conductive elastic plate 132 at the side end face of the support member 111 is brought into contact with the fixed electrode 134 when the support member 111 is rotated. Consequently, the alternating voltage impressed to the fixed electrode 134 provided out of the developing area from the alternating voltage source 135 is added to the electrode 131 through the conductive elastic plate 132, thus effecting the action of the electric field curtain at positions except the developing area.

According to the embodiment, the electric field curtain generating means 130 is further provided with an electric field curtain generating means 140 for development use in the developing area between the developing material support member 111 and the image holding member 120. The electric field curtain generating means 140 consists of the plurality of electrode wires 141 arranged a predetermined distance from each other and in parallel in an axial direction of the support member 111. The electrode wires 141 having an alternately opposite polarity of voltage to be impressed are connected to an alternating current source 143 through an alternating current transformer 142.

The electrode wires 141 when impressed with the alternating voltage from the alternating current source 143 cause the electric field curtain to act, thereby to float the developing material 112 transported to the developing area for supply thereof to the electrostatic latent image.

In order to supply the developing material 112 transported to the developing area from on the support member 111 to the electrode wires 141, according to the present embodiment, the fixed electrodes 134 provided in the side end face of the inner roller 133 in the developing area are connected to the bias source 144.

In this case, when the conductive elastic plate 132 comes in contact with the fixed electrode 134 connected to the bias source 144 as the developing material support member 111 is rotated, the electric field curtain generating electrode 131 connected to the conductive elastic plate 132, namely, the electrode 131 in the developing area is impressed with the bias voltage from the bias source 144, and accordingly the electric field is formed between the support member 111 and the electrode wire 141. Thus, the charged developing material 112 is separated from on the support member 111 and guided to the electrode wire 141.

On the other hand, insufficiently-charged developing material 112 is not guided to the electrode wire 141 even in the presence of the electric field, remaining on the support 111. Accordingly, the above insufficiently-charged developing material can be prevented from scattering.

As is made clear from the foregoing description of the second embodiment, the developing apparatus is provided with the electric field curtain generating means on the developing material support member so as to effect the action of the electric field curtain at positions except the developing area for transportation of the developing material. Moreover, the developing apparatus is provided with the electric field curtain generating means between the support member and the image holding member, so that the developing material is made floating by the action of the electric field curtain and softly supplied to the position of an electrostatic latent image formed on the image holding member. Therefore, by the developing apparatus of the second embodiment, the electric field curtain can act under respective favorable conditions both in the case where the developing material is transported to the developing area and in the case where the floating developing material is fed to the image holding member. In comparison with the prior art developing apparatus utilizing the action of the electric field curtain in a conventional manner, the developing apparatus of this invention can prevent that the developing material from being sufficiently charged, and not properly transported to the developing area and the image holding member, resulting in scattering thereof, or fogging of a formed image, with deterioration of the image quality.

Although the present invention has been fully described by way of examples with reference to the accompanying drawings, it is to be noted that various changes and modifications Will be apparent to those skilled in the art. Therefore, unless otherwise such changes and modifications depart from the scope of the present invention, they should be construed as being included therein.

What is claimed is:

1. A developing apparatus which comprises:

an electrostatic latent image bearing member for bearing an electrostatic latent image;

a developer transporting member for transporting a developer along its surface;

a first electric field curtain generating means for generating a powder cloud of the developer on the surface of said developer transporting member by electric field curtain force, for causing an electric field curtain to act at positions except for a developing area where said developer transporting member confronts with said electrostatic latent image bearing member; and a second electric field curtain generating means disposed between said electrostatic latent image bearing and said developer transporting member so as to supply the developer of the powder cloud to the electrostatic latent image at the developing area by electric field curtain force.

2. A developing apparatus which comprises:

developer transporting means for transporting a layer of developer along its surface and including a plurality of first electrodes to which an alternating current voltage is applied;

an electrostatic latent image bearing member for bearing an electrostatic latent image, said electrostatic latent image bearing member disposed to confront with said developer transporting means so as to define a developing region therebetween;

a plurality of second electrodes disposed at said developing region and being applied thereto an alternating current voltage;

first applying means for applying the alternating current voltage to said first electrodes except in the area corresponding to said developing region so as to form a powder cloud of the developer where the alternating current voltage is applied; and second applying means for applying the alternating current voltage to said second electrodes so as to attract the powder cloud of the developer to the developing region to develop the electrostatic latent image.

3. A developing apparatus as claimed in claim 2, wherein said developer transporting means is a rotatably disposed cylindrical shaped member.

4. A developing apparatus as claimed in claim 2, wherein said first alternating voltage applying means including bias voltage applying means for applying a bias voltage to the developer transporting means in the area corresponding to said developing region.

5. A developing apparatus as claimed in claim 2, which further comprises:

a developer supply means for supply developer onto said developer transporting means, said developer supply means including charging means for charging the developer before the developer is supplied said developer transporting means.

6. A developing apparatus as claimed in claim 5, wherein said charging means comprises a rotating roller and a pressing member pressing the surface of the roller wherein developer is pressed by said pressing member so as to be frictionally charged.

7. A developing apparatus which comprises:

a developer support member for supporting a developer on its surface;

an electrostatic latent image bearing member for bearing an electrostatic latent image, said electrostatic latent image bearing member disposed to confront with said developer support member so as to define a developing region therebetween;

driving means for rotating said developer support member;

a first group of electrodes provided on the surface of developer support member and insulated from each other;

a first alternating voltage applying means for applying alternating current voltage to said first group of electrodes in an area except where said developer support member confronts with said electrostatic latent image bearing member so as to transport developer with forming a powder cloud of the developer by electric field curtain force when said developer support member is rotated by the driving means;

a second group of electrodes provided at the developing region and provided along a direction parallel to the rotating axis of said developer support member; and a second alternating voltage applying means for applying alternating current voltage between neighboring electrodes of said second group of electrodes so as to supplying the transported developer to the electrostatic latent image by electric field curtain force.

8. A developing apparatus for developing an electrostatic latent image, which comprises;

an electrostatic latent image bearing member for bearing an electrostatic latent image;

a developer support member provided to confront said electrostatic latent image bearing member;

driving means for rotating said developing support member;

a first group of electrodes provided on the surface of said developer support member and insulated from each other;

an inner roller built in said support member;

a second group of electrodes each provided corresponding to said first group of electrodes in a side end face of said support member to be electrically connected with said first group of electrodes;

a third group of electrodes each provided in a side end face of said inner roller in an area except where said developer support member confronts said electrostatic latent image bearing member, said third group of electrodes are periodically touched with said second group of electrodes in accordance with the rotation of the developer support member by the driving means;

a first alternating voltage source for applying an alternating current voltage to said third group of electrodes, wherein the alternating current voltage is applied to said second group of electrodes through said third group of electrodes so as to generate an electric field curtain so that the developer forms a powder cloud on the surface of the developer support member by electric field curtain force when said developer support member is rotated by the driving means;

a fourth group of electrodes provided between said electrostatic latent image bearing member and said developing material support member and provided along a direction parallel to the rotating axis of said developer support member; and a second alternating voltage applying means for applying alternating current voltage between neighboring electrodes of said fourth group of electrodes so as to supplying the generated powder cloud to the electrostatic latent image by electric field curtain force.

* * * * *